US006010269A

United States Patent [19]

Yokosuka et al.

[11] Patent Number: 6,010,269

[45] Date of Patent: Jan. 4, 2000

[54] WRITING IMPLEMENT

[75] Inventors: Takehiko Yokosuka; Takao Inaba; Hideyuki Tanaka, all of Aichi, Japan

[73] Assignee: The Pilot Ink Co., Ltd., Aichi, Japan

[21] Appl. No.: 09/173,166

[22] Filed: Oct. 15, 1998

[30] Foreign Application Priority Data

Oct. 15, 1997 [JP] Japan ..... 9-299383

[51] Int. Cl.[7] ..... B43K 7/02

[52] U.S. Cl. ..... 401/217; 401/232; 401/242

[58] Field of Search ..... 401/217, 232, 401/242, 276, 233

[56] References Cited

U.S. PATENT DOCUMENTS

| | | | |
|---|---|---|---|
| 2,732,829 | 1/1956 | Fehling | 401/217 |
| 2,871,824 | 2/1959 | Sams | 120/42.4 |

FOREIGN PATENT DOCUMENTS

| | | | |
|---|---|---|---|
| 0 626 276 | 11/1994 | European Pat. Off. | B43K 7/08 |
| 816 966 | 10/1951 | Germany . | |
| 1110 548 | 7/1961 | Germany | B43C 5/20 |
| 453137 | 11/1949 | Italy | 401/217 |
| 6-115291 | 4/1994 | Japan | B43K 7/00 |
| 2 278 578 | 12/1994 | United Kingdom | B43K 23/00 |
| WO 97/22483 | 6/1997 | WIPO | B43K 7/02 |

*Primary Examiner*—David J. Walczak
*Attorney, Agent, or Firm*—Sughrue, Mion, Zinn, Macpeak & Seas, PLLC

[57] ABSTRACT

Ink and a follower advancing with consumption of the ink are stored directly in the inside of a barrel having a pen point at its forward end. An outer tail plug constituted by a closed-end cylinder is fitted to a rear outer surface of the barrel. An air course is formed between the rear outer surface of the barrel and an inner surface of the outer tail plug to communicate with the inside of the barrel through a rear end aperture portion of the barrel. At least one air hole is provided ahead of the rear end aperture portion of the barrel to make the air course communicate with the outside air.

11 Claims, 9 Drawing Sheets

WRITING IMPLEMENT

BACKGROUND OF THE INVENTION

1. Field of the Invention

The present invention relates to a writing implement, and particularly to a writing implement in which ink and a follower advancing with consumption of the ink are stored directly inside a barrel having a pen point at its forward end.

2. Description of the Related Art

In such a conventional writing implement, ink and a follower are stored in a barrel directly, and a tail plug (corresponding to an inner tail plug in the present invention) having a ventilating means is fitted to the inner surface of a rear end aperture portion of the barrel, as disclosed, for example, in Unexamined Japanese Patent Publication (kokai) No. Hei 6-115291.

Particularly, in such a writing implement in which ink and a follower are stored in a barrel directly, while a large volume of ink can be stored, the ink is apt to flow back (that is, go down) by the own weight of the large volume of ink when the pen point is directed upward. Therefore, in the conventional writing implement, a back-flow valve system constituted by a ball valve actuated by the own weight of a ball valve (generally a metallic ball) is provided in the tail plug in order to prevent the ink from flowing back when the pen point is directed upward.

However, in the conventional writing implement, since an air hole is formed at the rear end of the tail plug, dust or dirt is apt to enter the air hole of the tail plug from the outside. Therefore, there is a fear of hampering the valve function of the back-flow valve system. If the back-flow valve system cannot operate normally, there is a fear that ink leaks directly to the outside through the air hole. Further, if the writing implement is put into a pocket of clothes at that time, the leaking ink will make the clothes dirty. That is, conventionally, such a writing implement does not have any safety measures against failure in operation of the back-flow valve system. Therefore, there is a fear that an accident of ink leaking from the rear end of the writing implement occurs.

SUMMARY OF THE INVENTION

It is an object of the present invention to provide a writing implement in which while a large volume of ink can be stored, the ink can be prevented from leaking from the rear end of the writing implement surely to thereby conspicuously improve the safety against ink leakage accidents. In the present invention, "ahead" means a pen point side, and "rear" means a tail plug side.

A writing implement according to the present invention comprises: a barrel in the inside of which ink and a follower advancing with consumption of the ink are stored directly, the barrel having a pen point at its forward end; and an outer tail plug constituted by a closed-end cylinder and fitted to a rear outer surface of the barrel so that an air course is formed between the rear outer surface of the barrel and an inner surface of the outer tail plug to communicate with the inside of the barrel through a rear end aperture portion of the barrel; wherein at least one air hole is provided ahead of the rear end aperture portion of the barrel to make the air course communicate with the outside air.

In the above structure according to the present invention, since the outer tail plug does not cover the whole of the barrel, it is possible to make the diameter of the barrel large, so that the volume of stored ink can be increased. In addition, since the air hole is provided at the rear of the grip portion, it is possible to prevent the air hole from being closed by a finger at the time of writing, so that there is no fear that the ventilation performance of the air course is hampered.

DETAILED DESCRIPTION OF THE INVENTION

Figure 1:
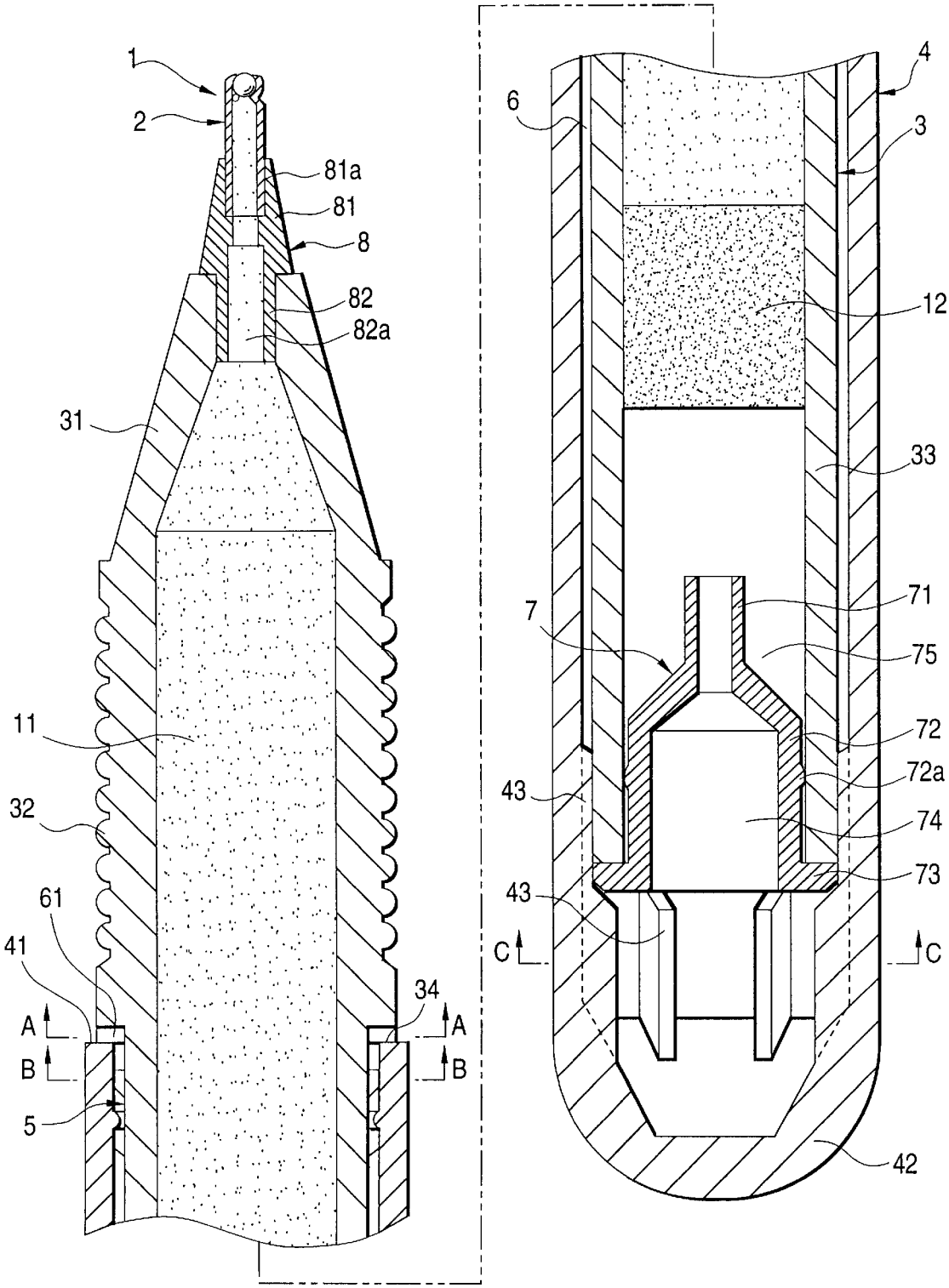
FIG. 1 is a longitudinal sectional view illustrating a first embodiment of the present invention.
Figure 2:
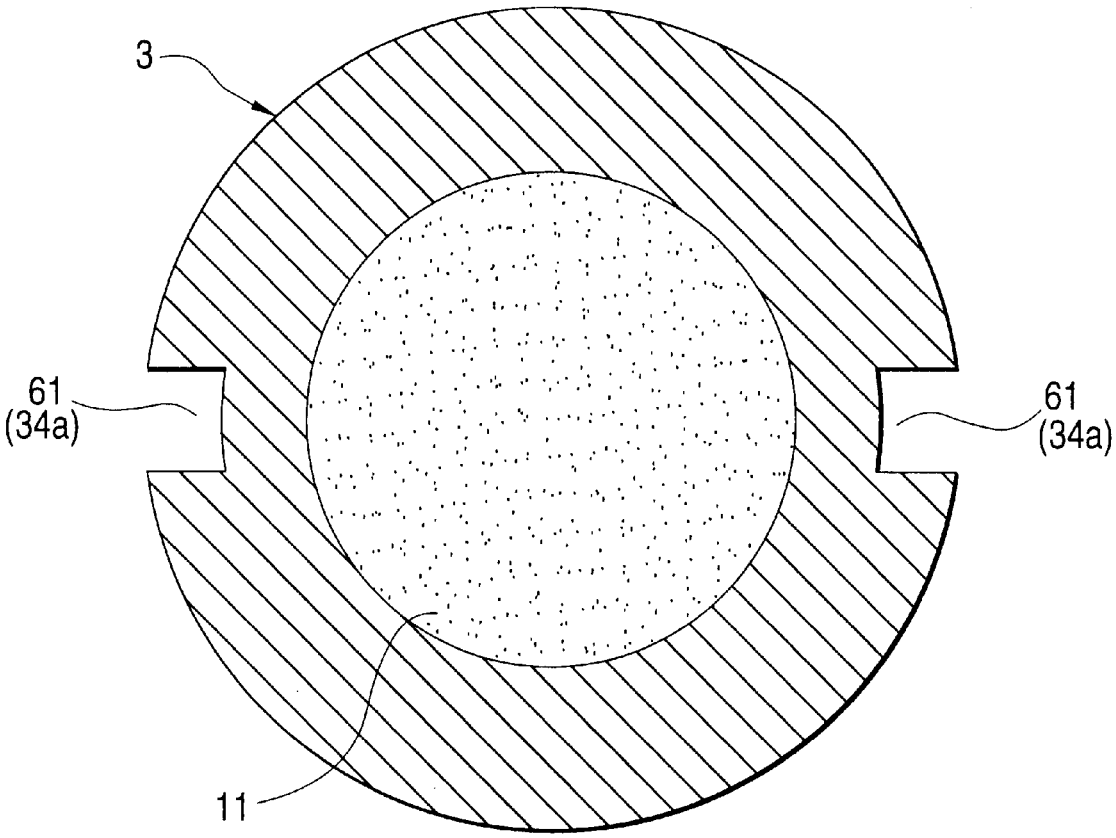
FIG. 2 is an enlarged sectional view taken on line A—A in FIG. 1.

Detailed description of the present invention will be described as follows referring to the accompanying drawings.

(1) A writing implement 1 according to the present invention has a barrel 3 in the inside of which ink 11 and a follower 12 advancing with consumption of the ink 11 are stored directly. The barrel 3 has a pen point 2 at its forward end. The writing implement also has an outer tail plug 4 constituted by a closed-end cylinder and fitted to a rear outer surface of the barrel 3. An air course 6 is formed between the rear outer surface of the barrel 3 and an inner surface of the outer tail plug 4 so as to communicate with the inside of the barrel 3 through a rear end aperture portion of the barrel 3. At least one air hole 61 is provided ahead of the rear end aperture portion of the barrel 3 so as to make the air course communicate with the outside air. (see, FIGS. 1, 7, 8 and 9)

In the above-mentioned configuration (1), the outer tail plug 4 is fitted to the outer surface of the rear of the barrel 3, so as to cover the outer circumferential surface of the rear end aperture portion of the barrel 3. The air hole 61 is positioned ahead of the rear end aperture portion of the barrel 3. Accordingly, the air course 6 takes a roundabout route from the rear end aperture portion of the barrel 3 to the front of the insertion portion 33. As a result, even if the ink 11 leaks out of the rear end aperture portion of the barrel 3, the ink 11 is prevented from leaking at least to the outside from the rear end of the writing implement 1 because the outer tail plug 4 has its bottom portion (closed wall portion 42) and no hole is provided at the rear end of the writing implement 1. Consequently, the safety against ink leakage is improved.

In addition, the air course 6 communicates not only with the outside air through the air holes 61, but also with the inside of the barrel 3 (that is, a space at rear of the follower 12 inside the barrel 3) through the rear end aperture portion of the barrel 3. Accordingly, the inside of the barrel 3 is always at the atmospheric pressure, so that the ink 11 and the follower 12 can move ahead with consumption of the ink 11 at the time of writing. The outer tail plug 4 is preferably a closed end cylinder having an aperture end portion 41 on one side and a closed wall portion 42 on the other side.

(2) It is preferable that the writing implement 1 according to the above configuration (1) has a grip portion 32 provided on the outer surface of the barrel 3 at a portion in front of the outer tail plug 4, the air hole 61 being disposed in the rear of the grip portion 32. (see, FIGS. 1, 7, 8 and 9)

In the above-mentioned configuration (2), the outer tail plug 4 is fitted to the rear portion of the barrel 3 with leaving the grip portion 32 at the front portion of the barrel 3. It is therefore possible to set the outer diameter of the grip portion 32 to be thick enough to be easily held by a hand desirably and independently of the outer diameter of the outer tail plug 4. In addition, since the outer tail plug 4 does not cover the whole of the barrel 3, it is possible to make the diameter of the barrel 3 large, so that the volume of stored ink can be increased. If the grip portion 32 is formed on the outer circumferential surface of the outer tail plug 4, the outer tail plug 4 covers the front portion of the barrel 3, so that the diameter of the barrel 3 becomes small and the volume of the stored ink is reduced.

In addition, since the air hole 61 is provided at the rear of the grip portion 32, it is possible to prevent the air hole 61 from being closed by a finger at the time of writing. Accordingly, there is no fear that the ventilation performance of the air course 6 is hampered.

The grip portion 32 is, usually, a portion which is held by a user by his/her forefinger and thumb at the time of writing. Specifically, it is preferable to provide a rough portion (for example, an annular protrusion, an annular groove, a spiral protrusion, a spiral groove, a dotted protrusion, a dotted recess, or the like) or an anti-skid portion of elastic material in the front portion of the barrel 3 integrally with the barrel 3 or separately therefrom. However, a smooth surface may be used so long as it can function as the grip portion.

In addition, at the time of writing, the grip portion 32 is held by fingers while the outer surface of the outer tail plug 4 is usually supported between a forefinger and a thumb. To satisfy a proper function to support the outer tail plug 4 by fingers, the outer tail plug 4 is preferably a non-flexible cylinder of, for example, material such as metal, synthetic resin, etc.

(3) In the writing implement 1 according to the above configuration (1) or (2), preferably, the air course 6 is disposed in a connection portion 5 between the outer surface of the barrel 3 and the inner surface of the outer tail plug 4. (see, FIGS. 1, 7, 8 and 9)

In the above-mentioned configuration (3), it is possible to avoid the pressure increase inside the outer tail plug 4 (that is, a space at rear of the follower 12 inside the barrel 3) when the outer tail plug 4 is fitted to the barrel 3, so that ink can be prevented from leaking from the pen point 2.

In addition, the inner surface of the outer tail plug 4 is fitted to the outer surface of the rear of the barrel 3. As for the specific structure of the connection portion 5 between the inner surface of the outer tail plug 4 and the outer surface of the barrel 3, it is possible to employ, for example, fitting, screwing, bonding, welding, and the like. Of them, fitting is preferable in view of easiness in manufacturing and assembling. The above-mentioned "fitting" includes, for example, getting-over fitting, press fitting, and the like.

In addition, when the connection structure of the connection portion 5 employs fitting, in order to provide the air course 6 in the connection portion 5, it is preferable that a protrusion for fitting is provided on the outer surface of the barrel 3 or the inner surface of the outer tail plug 4, and an air groove is provided thereat.

(4) In the writing implement 1 according to the above configuration (1), (2) or (3), it is preferable to provide such a configuration that the air hole 61 is disposed in the aperture end portion 41 of the outer tail plug 4, though a transverse hole may be formed as the air hole 61 in the outer surface of the outer tail plug 4. (see, FIGS. 1, 7, 8 and 9)

In the above-mentioned configuration (4), the air hole 61 may be disposed ahead of the rear end of the writing implement 1 as far as possible. Consequently, the air course 6 (that is, the longitudinal distance between the rear end of the barrel 3 and the air holes 61) may be elongated so that not only it is possible to prevent ink from leaking more surely, but also it is unnecessary to form a transverse hole in the outer surface of the outer tail plug 4 in order to provide the air hole 61. Therefore, manufacturing becomes easy because of a simple structure.

(5) In addition, in the writing implement 1 according to the above configuration (1), (2), (3) or (4), it is preferable that a plurality of air holes 61 are provided. (see, FIGS. 1, 7, 8 and 9)

This is because it is difficult for a user to hold the writing implement 1 by his/her fingers and close the two or more air holes 61 by the fingers at the same time when the user writes. Particularly, when the air holes 61 are provided at the rear of the grip portion 32 (the above configuration (2)), it is impossible to close the two or more air holes 61 by the fingers at the same time. That is, even if one of the air holes 61 is closed by a finger, the other air holes 61 are kept opened. Therefore, there is no fear that all the air holes 61 are closed by fingers, it is possible to maintain the ventilation performance of the air course 6 at the time of writing.

The follower 12 is disposed at rear of the ink 11 so as to be in contact therewith. The follower 12 is designed to advance with the consumption of the ink 11 at the time of writing so as to prevent the ink 11 from flowing back even when the pen point is directed upward. Specifically, examples of the follower may include a grease-like substance (including that which contains a gelatinizer blended with a volatilization-resistant or a non-volatile solvent so that it shows viscosity or visco-elasticity); a piston consisting of elastic material; a piston used together with the above grease-like substance, a rod or cylindrical synthetic resin molding used together with the above grease-like substance; and the like.

(6) Particularly, in the writing implement 1 according to the above configuration (1), it is preferable that the follower 12 is like grease. (see, FIGS. 1, 7, 8 and 9)

The grease-like follower 12 leaks to the outside through the rear end aperture portion of the barrel 3 easily in comparison with a piston. It is, however, possible to avoid ink leakage from the rear end of the writing implement 1 in cooperation with the configuration (1) (that is, the configuration in which the inner circumferential surface of the outer tail plug 4 constituted by a closed-end cylinder is fitted to the outer circumferential surface of the rear of the barrel 3).

Further, generally, when the follower 12 is grease-like, the grease-like substance is apt to adhere to the outer circumferential surface at the rear end of the barrel 3 in a manufacturing process. It is therefore necessary to wipe the grease-like substance out, conventionally. However, by the above configuration (1), the outer tail plug 4 covers the outer circumferential surface of the rear end of the barrel 3, so that it is not necessary to wipe the grease-like substance. As a result, not only it is possible to simplify the manufacturing process, but also there is no fear that, when decorating print is given to the outer circumferential surface of the barrel 3, the decorating print is damaged at the wiping working.

(7) In addition, in the writing implement 1 according to the above configuration (1) or (6), it is preferable that an inner tail plug 7 having an air hole 74 making the inside of the barrel 3 communicate with the outside is inserted into the inner surface of the rear end aperture portion of the barrel 3. (see, FIGS. 1, 8 and 9)

As a result, when the ink 11 or the ink 11 and the grease-like follower 12 flow back, first, ink leakage from the rear end aperture portion of the barrel 3 can be restrained by the inner tail plug 7, so that the safety against ink leakage is improved more greatly in cooperation with the ink leakage prevention effect of the outer tail plug 4.

(8) In addition, in the writing implement 1 according to the above configuration (1), (6) or (7), it is preferable that a back-flow valve system 9 opened at the time of writing and closed at the time of non-writing is provided inside the pen point 2, near the pen point 2 inside the barrel 3, or at rear of the follower 12 inside the barrel 3. (see, FIGS. 8 and 9)

The back-flow of the ink in the barrel 3 is restrained by the back-flow valve system 9 in the above-mentioned configuration (8). Accordingly, the safety against ink leakage is improved more greatly in cooperation with the effect of the outer tail plug 4 to prevent the ink from leaking from the rear end of the writing implement.

Specifically, examples of the back-flow valve system 9 include a valve system provided in the pen point 2, in an ink flow hole 82*a* of a holder 8, or in the air hole 74 of the inner tail plug 7 so that it closes when the pen point is directed upward and opens when the pen point is directed downward; a valve system in which when the pen point is a ball point pen, a ball (that is, ball valve) of the pen point is urged ahead by a spring or the like so that the ball valve is opened by the writing pressure at the time of writing; and the like.

Figure 8:
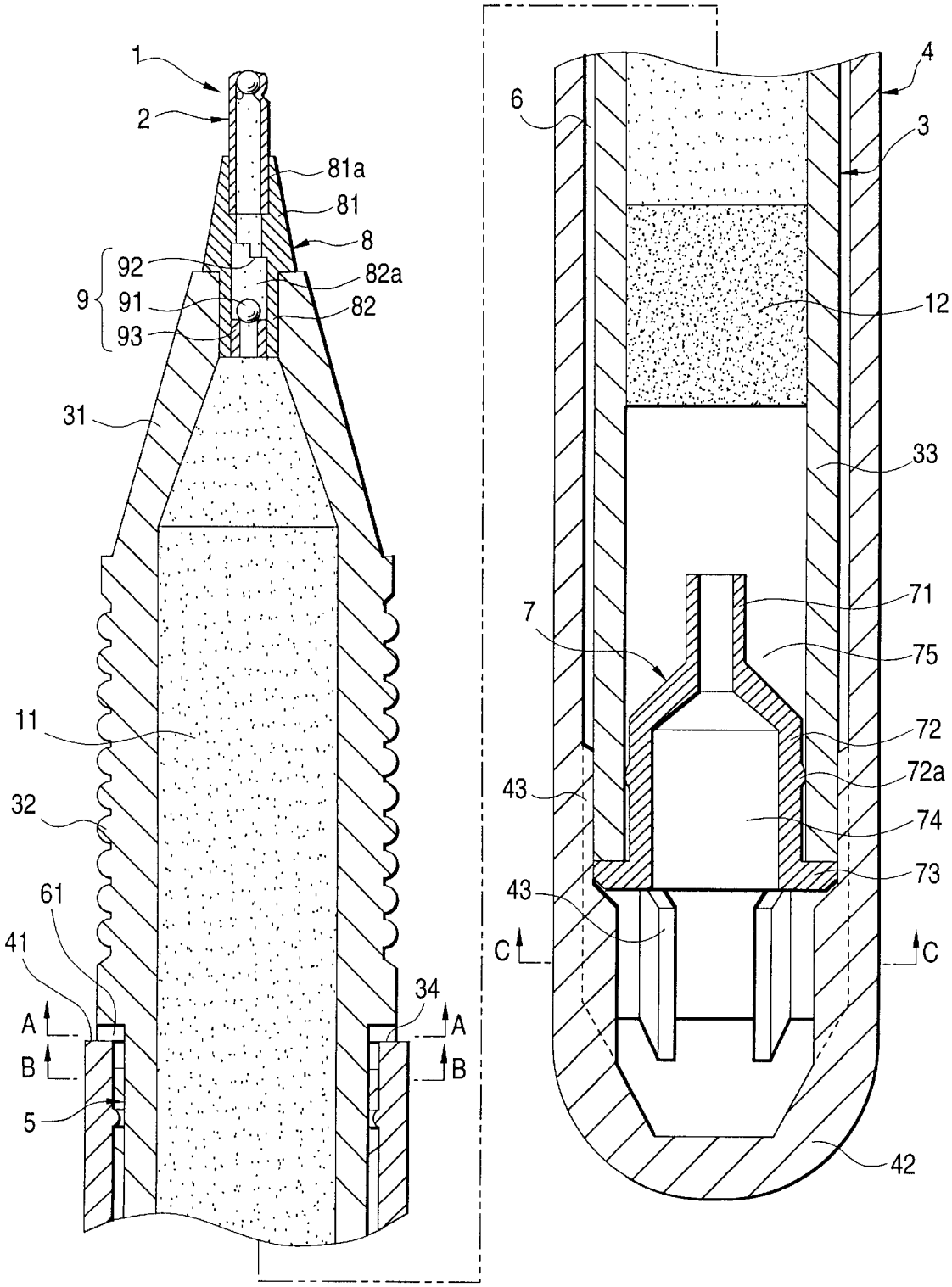
FIG. 8 is a longitudinal sectional view illustrating a third embodiment of the present invention.
Figure 9:
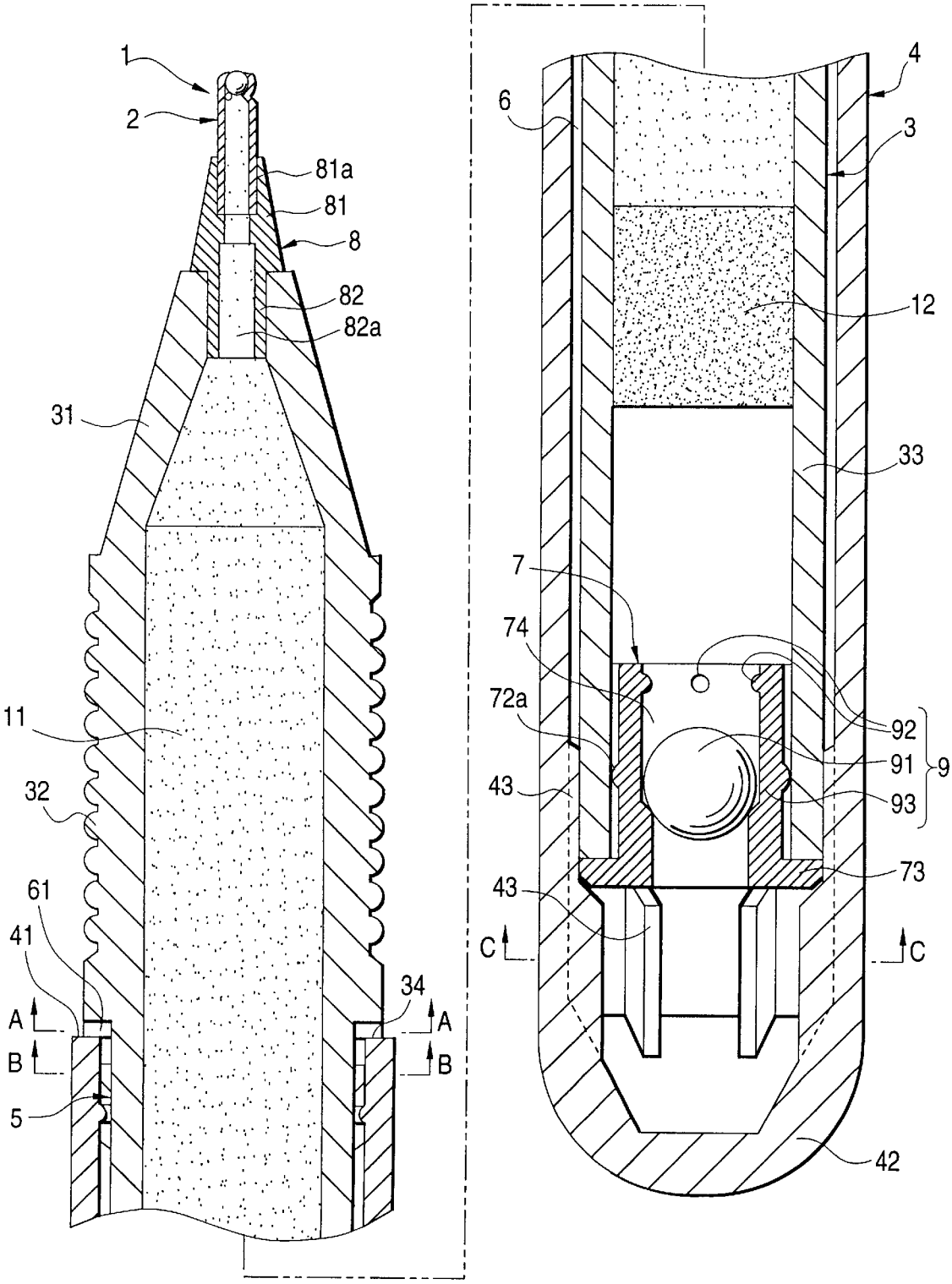
FIG. 9 is a longitudinal sectional view illustrating a fourth embodiment of the present invention.

For example, FIG. 8 shows a configuration in which the back-flow valve system 9 is provided in the holder 8, and FIG. 9 shows a configuration in which the back-flow valve system 9 is provided in the inner tail plug 7. In addition, though not shown, the back-flow valve system 9 may be provided both in the holder 8 and in the inner tail plug 7.

Water-based ink, oil ink, water-based or oil ink having shear-thinning properties, etc. may be used suitably as the ink 11 in the present invention.

Examples of the pen point 2 in the present invention include a ball-point-pen pen point; a resin-finished body of fiber bundle; a thermally-fused body of fiber bundle; a felt-finished body; a continuous porous body of synthetic resin; an extrusion molding or an injection molding of synthetic resin having an ink guide path provided axially; a fountain pen type plate pen body; a tubuliform pen body; a brush-like pen body; and the like. The pen point may be fixed to the front end of the barrel 3 directly, or fixed indirectly through another member such as a holder 8 or the like.

Embodiments of the present invention will be described with reference to the drawings.

First Embodiment

A first embodiment of the present invention will be described as follows referring to FIGS. 1 to 6.

A writing implement 1 in the first embodiment is a ball point pen constituted by a ball-point-pen pen point 2, a holder 8 provided with the ball-point-pen pen point 2 in its forward end, a barrel 3 having the holder 8 fixed to its forward end and storing ink 11 and a follower 12 therein, an inner tail plug 7 fitted to the inner surface of a rear end aperture portion of the barrel 3, and an outer tail plug 4 fitted to the rear outer surface of the barrel 3 including the outer surface of the rear end aperture portion.

(Barrel)

The barrel 3 is a cylindrical body obtained by injection-molding of synthetic resin (for example, polypropylene or the like). In the barrel 3, a tapered portion 31 to which the pen point 2 is fixed, a grip portion 32 disposed on the front outer circumferential surface of the barrel 3 at the rear of the tapered portion 31, and an insertion portion 33 the diameter of which is smaller than that of the grip portion 32 are formed integrally with each other. Incidentally, it is not always necessary to form them integrally.

The grip portion 32 has a plurality of convex and concave stripes formed integrally and circumferentially on the front outer circumferential surface of the barrel 3. The grip portion 32 has an anti-skid function.

Water-based ink 11 having shear-thinning properties is charged into the barrel 3, and a grease-like follower 12 is charged into the barrel 3 at rear of the ink 11.

A step portion 34 contacting with an open end portion 41 of the outer tail plug 4 is formed between the grip portion 32 and the insertion portion 33 (that is, at the base end of the insertion portion 33). In addition, recess portions 34*a* opened outward in the radial direction and backward in the axial direction are formed at two places in the step portion 34 at an equal interval (see FIGS. 2 and 5). As a result, when the outer tail plug 4 is fitted to a rear portion of the barrel 3, not only the open end portion 41 of the outer tail plug 4 abuts against the step portion 34, but also two air holes 61 are formed between the open end portion 41 and the step portion 34. The air holes 61 has a rectangular shape which is long in the periphery direction of the outer tail plug 4. Specifically, the height of the air holes 61 may be in the range of 0.2 mm to 0.4 mm, and the width may be in the 1 mm to 3 mm.

Figure 3:
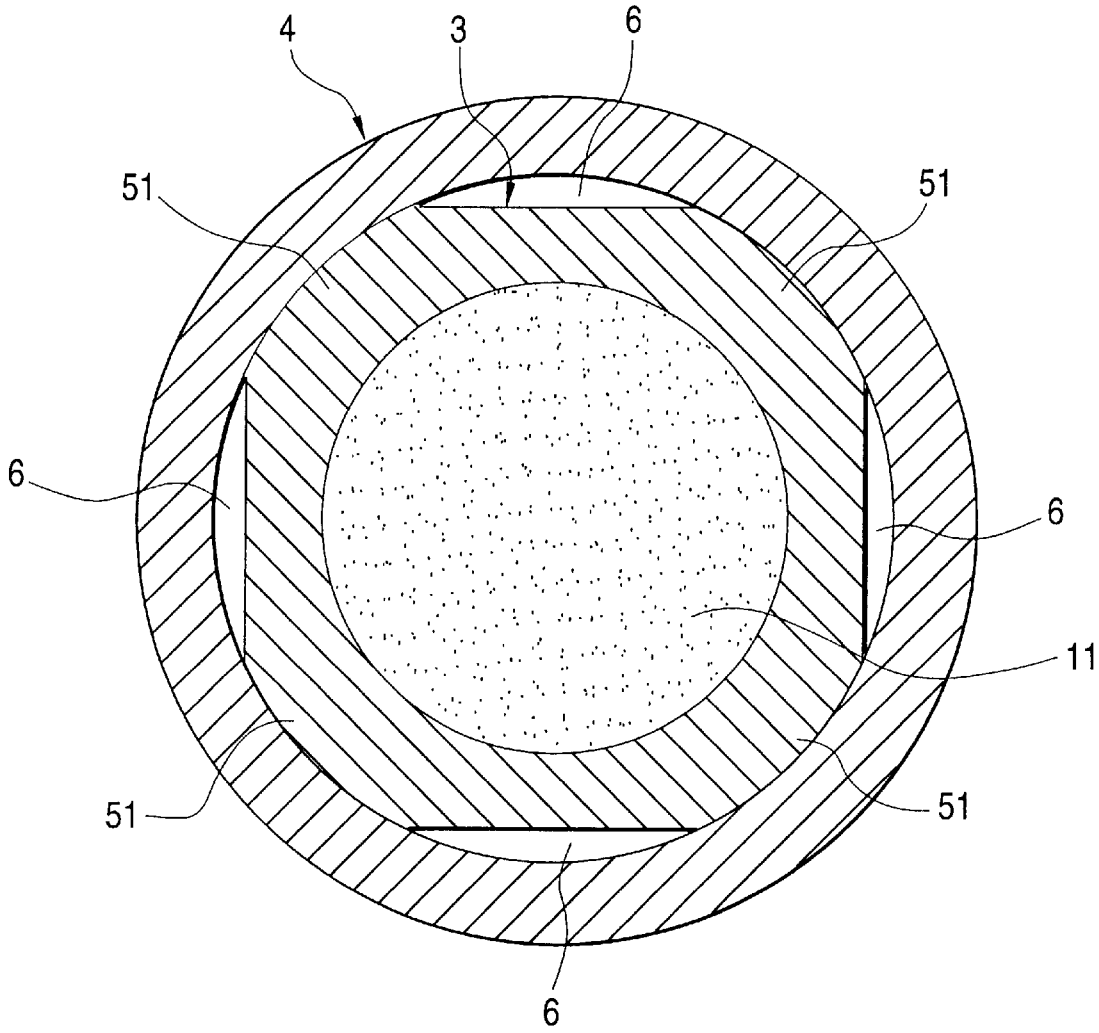
FIG. 3 is an enlarged sectional view taken on line B—B in FIG. 1.
Figure 5:
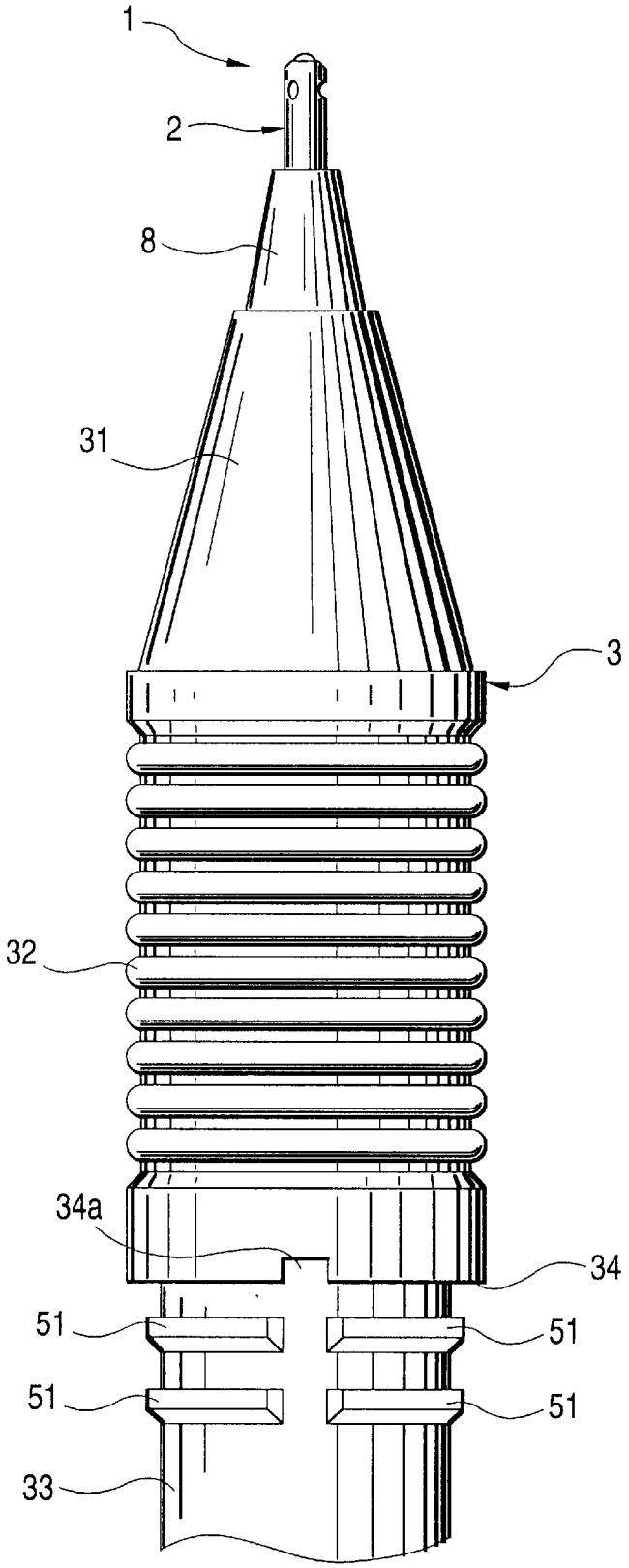
FIG. 5 is a main part outline view of a barrel in FIG. 1.

In addition, on the outer circumferential surface of the barrel 3 near the base end of the insertion portion 33, a plurality of (herein, four) fitting protrusions 51 for constituting a connection portion 5 are formed in two lines at a circumferential interval on the outer circumferential surface near the base end of the insertion portion 33 of the barrel 3 (see FIGS. 3 and 5).

(Outer Tail Plug)

The outer tail plug 4 is a closed-end cylindrical body having the open end portion 41 at one end and a closed wall portion 42 at the other end. The outer tail plug 4 is obtained by injection-molding of synthetic resin (for example, polypropylene or the like). The insertion portion 33 of the barrel 3 is inserted into the outer tail plug 4 from the open end portion 41 of the outer tail plug 4. In addition, decorating is given onto the outer circumferential surface of the outer tail plug 4 by transfer printing.

Figure 6:
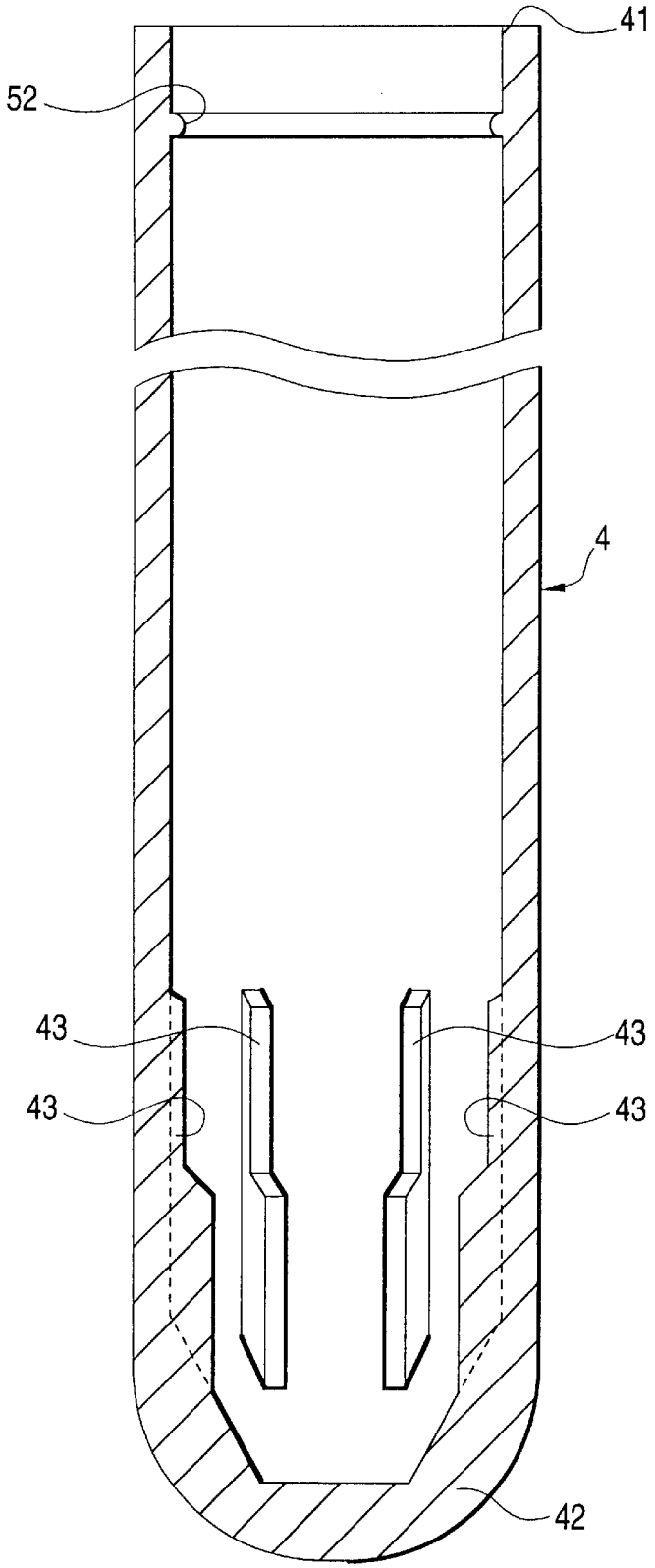
FIG. 6 is a longitudinal sectional view of an outer tail plug in FIG. 1.

In addition, in the inner circumferential surface of the outer tail plug 4 near the open end portion 41, an annular fitting protrusion 52 constituting the connection portion 5 is formed integrally with the outer tail plug 4 (see FIG. 6).

The connection portion 5 between the outer tail plug 4 and the barrel 3 is disposed between the rear aperture portion of the barrel 3 and the air holes 61. The connection portion 5 has a function to prevent the outer tail plug 4 from being detached from the barrel 3. The connection portion 5 is constituted by a plurality of fitting protrusions 51 provided at two, ahead and rear, stages on the outer circumferential surface of the barrel 3, and the annular fitting protrusion 52 provided on the inner circumferential surface of the outer tail plug 4. When the outer tail plug 4 is fitted to the outer surface of the insertion portion 33 of the barrel 3, the plurality of fitting protrusions 51 are pressed against the inner circumferential surface of the outer tail plug 4, while the annular fitting protrusion 52 gets over the group of fitting protrusions 51 at the rear stage. Consequently, it is possible to realize such a secure structure that the outer tail plug 4 cannot be detached easily from the barrel 3 at the time of writing.

In addition, the inner diameter of the outer tail plug 4 excluding the connection portion 5 and a support portion 43 is set to be larger than the outer diameter of the insertion portion 33 of the barrel 3 excluding the connection portion 5, so that a cylindrical air course 6 is formed between the inner surface of the outer tail plug 4 and the outer surface of the insertion portion 33 of the barrel 3 excluding the connection portion 5 and the support portion 43. Specifically, the inner diameter of the outer tail plug 4 is preferably in the range of 7.6 mm to 8.3 mm, and the outer diameter of the insertion portion 33 of the barrel 3 is preferably in the range of 7.4 mm to 7.8 mm. Namely, the difference between the inner diameter of the outer tail plug 4 and the outer diameter of the insertion portion 33 is preferably in the range of 0.2 mm to 0.5 mm. The distance between the inner surface of the outer tail plug 4 and the outer surface of the insertion portion 33 becomes in the range of 0.1 mm to 0.25 mm.

Further, when the inner surface of the outer tail plug 4 is fitted to the outer surface of the insertion portion 33 of the barrel 3, the annular fitting protrusion 52 on the inner surface of the outer tail plug 4 is not in contact with the outer circumferential surface of the barrel 3. Accordingly, the air course 6 is formed between the inner surface of the outer tail plug 4 and the outer surface of the barrel 3 by gaps among the plurality of fitting protrusions 51 (see FIG. 3). That is, the air course 6 extending from the rear aperture portion of the barrel 3 to the air holes 61 is provided through the connection portion 5.

Figure 4:
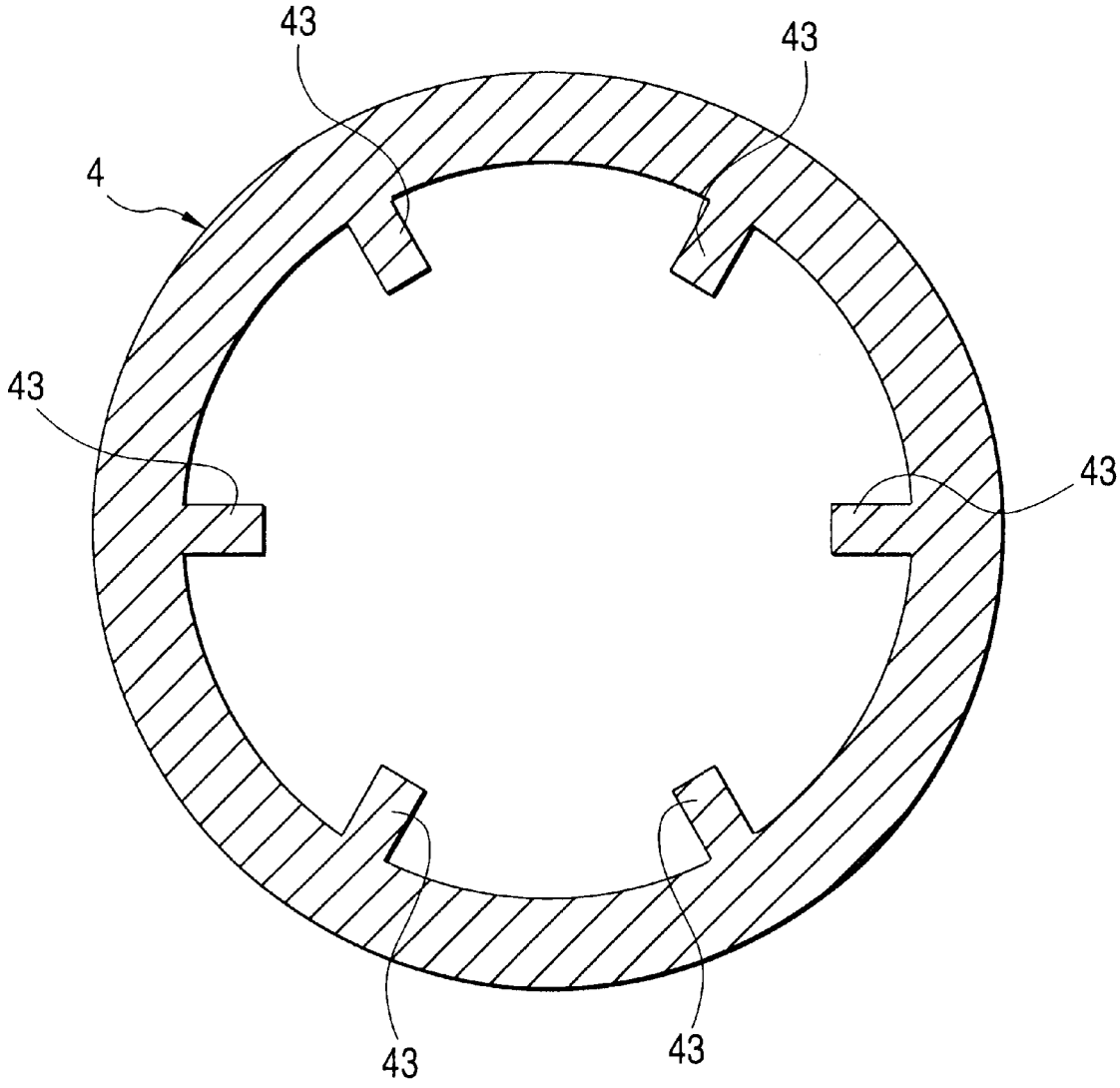
FIG. 4 is an enlarged sectional view taken on line C—C in FIG. 1.

In addition, on the inner surface of the outer tail plug 4 near the closed wall portion 42, the support portion 43 constituted by a plurality of (herein, six) ribs extending in the axial direction is provided integrally and inward in the radial direction (see FIGS. 4 and 6). The support portion 43 is fitted to the outer circumferential surface of the rear end of the barrel 3 (that is, the rear end of the insertion portion 33). Then, the support portion 43 supports radially the outer circumferential surface of the rear end of the barrel 3 so as to prevent looseness from occurring between the outer tail plug 4 and the barrel 3 at the time of writing. At the same time, the support portion 43 forms the air course 6 by gaps among its ribs. In addition, a portion of the support portion 43 disposed at rear of the rear end of the barrel 3 is made to project more inward in the radial direction, and positioned near the rear end of the inner tail plug 7 (that is, near the rear end surface of a collar portion 73) attached to the rear end aperture portion of the barrel 3. As a result, the inner tail plug 7 is prevented from being detached from the rear end aperture portion of the barrel 3.

(Inner Tail Plug)

The inner tail plug 7 is fitted to the inner surface of the rear end aperture portion of the barrel 3. The inner tail plug 7 is obtained by injection-molding of synthetic resin (for example, polypropylene or the like). The inner tail plug 7 is constituted by a small-diameter portion 71 at its front end, a large-diameter portion 72 provided continuously to the rear end of the small-diameter portion 71, and a collar portion 73 provided continuously to the rear end of the large-diameter portion 72. An annular protrusion **72*a* is provided integrally with the outer circumferential surface of the large-diameter portion 72 on the outer circumferential surface of the large-diameter portion 72. The annular protrusion 72*a* is pressed against the inner circumferential surface of the rear end aperture portion of the barrel 3. In addition, the front surface of the collar portion 73 abuts against the rear end surface of the barrel 3**.

An annular space 75 is formed between the outer circumferential surface of the small-diameter portion 71 and the inner circumferential surface of the barrel 3. When the ink 11 and the grease-like follower 12 move down, the annular space 75 reserves the ink 11 and the grease-like follower 12 temporarily so as to prevent the ink 11 and the grease-like follower 12 from leaking out. Further, an air hole 74 is provided through the center axis of the inner tail plug 7. Particularly, the inner diameter of the air hole 74 of the small-diameter portion 71 at the forward end of the inner tail plug 7 is 1.4 mm which is comparatively small so as to prevent the grease-like follower 12 from leaking out.

(Ball-point-pen pen point)

The ball-point-pen pen point 2 is of a pipe type in which a pipe of metal (specifically, stainless steel) is externally pressed and transformed so as to form a plurality of inward projecting portions which are made to be a ball seat. In front of the ball seat, a ball made of super alloy (having an outer diameter of 0.5 mm) is held rotatably. Alternatively, the ball-point-pen pen point 2 may be of a type in which a ball seat is formed by cutting and broaching of metal material.

(Holder)

The holder 8 is an injection-molding of synthetic resin (for example, polypropylene or the like). The holder 8 is constituted by a conical portion 81 having a fitting hole **81*a* into which the ball-point-pen pen point 2 is pressed and fixed, and a cylindrical portion 82 liquid-tightly fitted to the inner surface of the front end hole of the tapered portion 31 of the barrel 3 and having an ink flow hole 82*a* in its inside. The conical portion 81 and the cylindrical portion 82** are formed integrally with each other.

Second Embodiment

Figure 7:
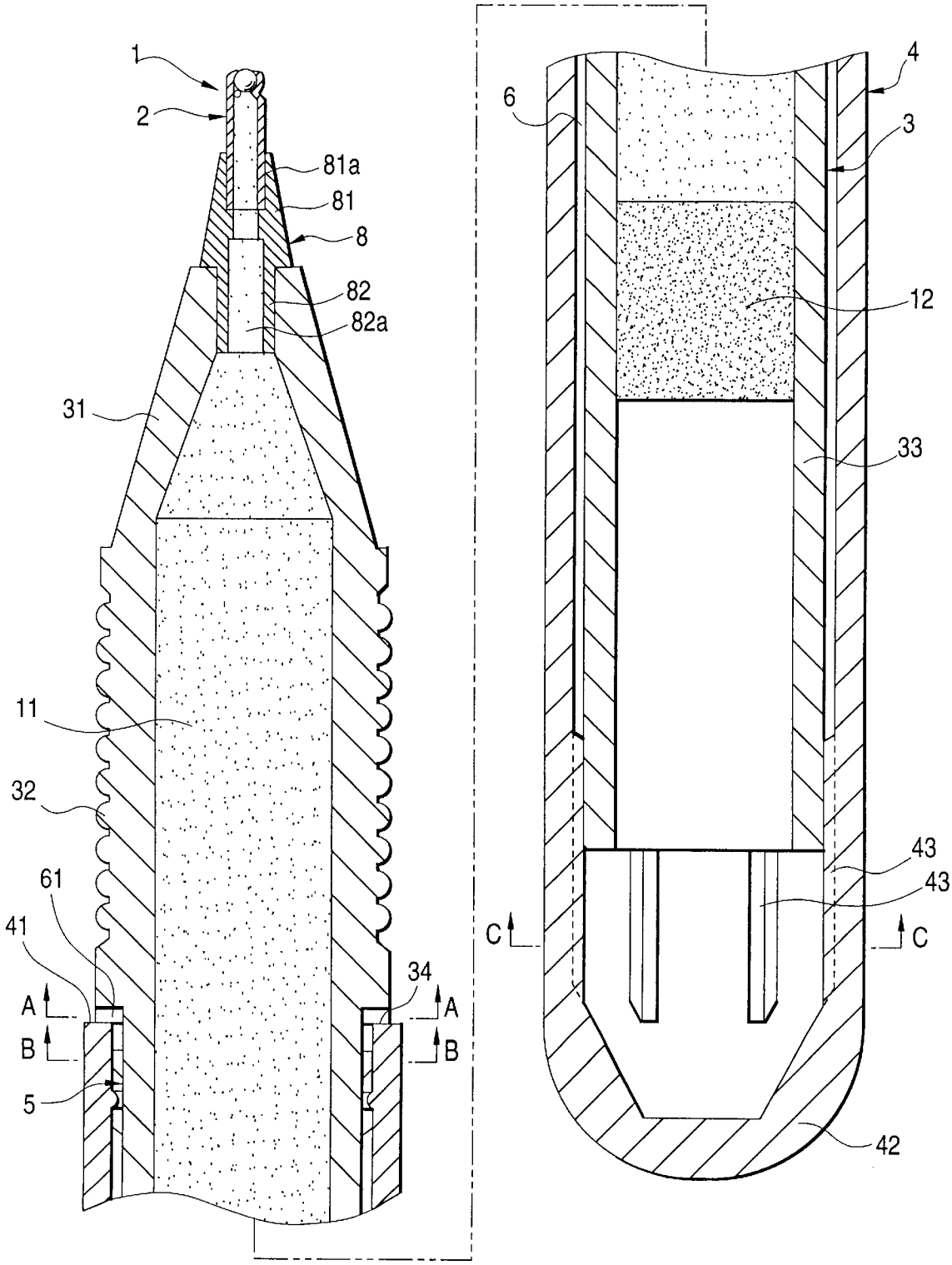
FIG. 7 is a longitudinal sectional view illustrating a second embodiment of the present invention.

A second embodiment of the present invention is shown in FIG. 7. This writing implement has a configuration in which the inner tail plug 7 is removed from the configuration of the writing implement 1 in the first embodiment (FIGS. 1 to 6). Thus, it is possible to realize a simple configuration in which the number of parts is reduced in comparison with the configuration of the implement 1 in the first embodiment. Accordingly, a writing implement in which the ink 11 and the grease-like follower 12 are prevented from leaking from the rear end of the writing implement can be provided at a low price. The other configuration than the inner tail plug 7 is the same as that in the first embodiment.

Third Embodiment

A third embodiment of the present invention is shown in FIG. 8. This writing implement has a configuration in which a back-flow valve system 9 is disposed in the ink flow hole **82*a* of the holder 8 in addition to the configuration of the writing implement 1 in the first embodiment (FIGS. 1 to 6). The other configuration than the back-flow valve system 9** is the same as that in the first embodiment.

The back-flow valve system 9 is constituted by a ball valve 91 which can move with a play in the front/rear direction inside the ink flow hole 82*a*, an abutment portion 92 supporting the ball valve 91 so as to allow ink to flow when the pen point is directed downward, and a valve seat 93 closed by the ball valve 91 tightly contacting therewith when the pen point is directed upward.

The back-flow of the ink 11 generated when the pen point is directed upward is restrained by the back-flow valve system 9. Further, even if the ink 11 flows back because of a strong impact such as falling or the like, ink leakage from the rear end of the writing implement 1 is prevented surely by the outer tail plug 4 in the same manner as in the first embodiment.

Fourth Embodiment

A fourth embodiment of the present invention is shown in FIG. 9. This writing implement has a configuration in which a back-flow valve system 9 is disposed in the air hole 74 of the inner tail plug 7 in addition to the writing implement 1 in the first embodiment (FIGS. 1 to 6).

The back-flow valve system 9 is constituted by a ball valve 91 which can move with a play in the front/rear direction inside the air hole 74, an abutment portion 92 supporting the ball valve 91 so as to allow ink to flow when the pen point is directed downward, and a valve seat 93 closed by the ball valve 91 tightly contacting therewith when the pen point is directed upward in the same manner as in the third embodiment (FIG. 8).

The ink 11 or the grease-like follower 12 can be prevented from leaking from the rear end aperture portion of the barrel 3 by the back-flow valve system 9 even if back-flow of the ink occurs when the pen point is directed upward or when a strong impact such as falling or the like is given to a writing implement. Further, attachment of the outer tail plug 4 enables to prevent dust or dirt from entering the air hole 74 of the inner tail plug 7, so that a proper valve function can be maintained. At the same time, ink leakage from the rear end of the barrel 3 can be prevented surely even if the back-flow valve system 9 is in failure in operation.

According to the first aspect of the present invention, an outer tail plug constituted by a closed-end cylinder is fitted to the rear outer surface of a barrel, an air course communicating with the inside of the barrel through a rear end aperture portion of the barrel is formed between the rear outer surface of the barrel and the inner surface of the outer tail plug, and an air hole making the air course communicate with the outside air is provided ahead of the rear end aperture portion of the barrel. With this configuration, not only a large volume of ink can be stored, but also the ink can be prevented from leaking from the rear end of the writing implement surely. Accordingly, the safety against ink leakage accidents is improved conspicuously.

According to the second aspect of the present invention, a grip portion is provided on the outer surface of the barrel in front of the outer tail plug, and the air hole is provided at the rear of the grip portion. With this configuration, it is possible to set the outer diameter of the grip portion to be thick enough to be easily held by a hand desirably and independently of the outer diameter of the outer tail plug. In addition, since the outer tail plug does not cover the whole of the barrel, it is possible to make the diameter of the barrel large, so that the volume of stored ink can be increased. In addition, since the air hole is provided at the rear of the grip portion, it is possible to prevent the air hole from being closed by a finger at the time of writing, so that there is no fear that the ventilation performance of the air course is hampered.

According to the third aspect of the present invention, the air course is provided in a connection portion between the outer surface of the barrel and the inner surface of the outer tail plug. With this configuration, it is possible to avoid the pressure increase inside the outer tail plug generated when the outer tail plug is fitted to the barrel, so that ink is prevented from leaking from a ball-point-pen pen point.

According to the fourth aspect of the present invention, the air hole is provided in an open end portion of the outer tail plug. With this configuration, the air hole can be disposed ahead of the rear end of the writing implement as far as possible. Consequently, the air course can be elongated so that it is possible to prevent ink from leaking more surely. In addition, manufacturing becomes easy because of a simple structure.

According to the fifth aspect of the present invention, a plurality of air holes are provided. With this configuration, there is no fear that all the air holes are closed by fingers, and it is possible to maintain the ventilation performance of the air course at the time of writing.

According to the sixth aspect of the present invention, the follower is made to be grease-like. With this configuration, it is possible to prevent the grease-like follower from leaking from the rear end of the writing implement in cooperation with the configuration stated in the first aspect. In addition, it is not necessary to wipe out the grease-like substance adhering to the outer circumferential surface of the rear of the barrel, so that the manufacturing process is simplified.

According to seventh aspect of the present invention, an inner tail plug having an air hole making the inside of the barrel communicate with the outside is inserted to the inner surface of the rear end aperture portion of the barrel. With this configuration, ink leakage from the rear end aperture portion of the barrel can be restrained by the inner tail plug, so that the safety against ink leakage accidents is improved more greatly in cooperation with the ink leakage prevention effect of the outer tail plug.

According to the eight aspect of the present invention, a back-flow valve system is provided inside the pen point, near the pen point inside the barrel, or at rear of the follower inside the barrel. With this configuration, the back-flow of the ink is restrained in the barrel, so that the safety against ink leakage accidents is improved more greatly in cooperation with the ink leakage prevention effect of the outer tail plug.

What is claimed is:

1. A writing implement comprising:

a barrel in the inside of which ink and a follower advancing with consumption of said ink are stored directly, said barrel having a pen point at its forward end;

an outer tail plug constituted by a closed-end cylinder and fitted to a rear outer surface of said barrel so that an air course is formed between the rear outer surface of said barrel and an inner surface of said outer tail plug to communicate with the inside of said barrel through a rear end aperture portion of said barrel; and an inner tail plug fitted to an inner surface of said rear end aperture portion of said barrel;

wherein at least one air hole is provided ahead of said rear end aperture portion of said barrel to make said air course communicate with the outside air; and wherein said inner tail plug has an air hole making the inside and outside of said barrel communicate with each other.

2. The writing implement according to claim 1, further comprising a grip portion provided on the outer surface of said barrel at a portion in front of said outer tail plug;

wherein said air hole being disposed in the rear of said grip portion.

3. The writing implement according to claim 2, wherein a plurality of said air holes are provided.

4. The writing implement according to claim 1, wherein said air course is disposed in a connection portion between the outer surface of said barrel and the inner surface of said outer tail plug.

5. The writing implement according to claim 4, wherein said connection portion is comprised of a plurality of protrusions and an annular fitting protrusion.

6. The writing implement according to claim 1, wherein said air hole is disposed in an open end portion of said outer tail plug.

7. The writing implement according to claim 1, wherein a plurality of said air holes are provided.

8. The writing implement according to claim 1, wherein said follower is in the form of grease.

9. The writing implement according to claim 8, further comprising a back-flow valve system provided one of near said pen point and at rear of said follower inside said barrel.

10. The writing implement according to claim 1, further comprising a back-flow valve system provided one of near said pen point and at rear of said follower inside said barrel.

11. A writing implement comprising:

a barrel in the inside of which ink and a follower advancing with consumption of said ink are stored directly, said barrel having a pen point at its forward end; and an outer tail plug constituted by a closed-end cylinder and fitted to a rear outer surface of said barrel so that an air course is formed between the rear outer surface of said barrel and an inner surface of said outer tail plug to communicate with the inside of said barrel through a rear end aperture portion of said barrel;

wherein at least one air hole is provided ahead of said rear end aperture portion of said barrel to make said air course communicate with the outside air;

wherein said air course is disposed in a connection portion between the outer surface of said barrel and the inner surface of said outer tail plug; and wherein said connector portion is comprised of a plurality of protrusions and an annular fitting protrusion.

* * * * *